US005988896A

United States Patent [19]

Edgar

[11] Patent Number: 5,988,896

[45] Date of Patent: Nov. 23, 1999

[54] METHOD AND APPARATUS FOR ELECTRONIC FILM DEVELOPMENT

[75] Inventor: Albert D. Edgar, Austin, Tex.

[73] Assignee: Applied Science Fiction, Inc., Austin, Tex.

[21] Appl. No.: 08/955,853

[22] Filed: Oct. 21, 1997

Related U.S. Application Data

[60] Provisional application No. 60/029,781, Oct. 21, 1997.

[51] Int. Cl.[6] ..... G03D 5/04

[52] U.S. Cl. ..... 396/604; 396/627; 396/639; 396/609

[58] Field of Search ..... 396/604, 611, 396/627, 639, 609; 430/418, 421, 423; 358/471, 500

[56] References Cited

U.S. PATENT DOCUMENTS

| | | | |
|---|---|---|---|
| 2,404,138 | 7/1946 | Mayer | 396/604 |
| 3,587,435 | 6/1971 | Chioffe | 396/627 |
| 3,747,120 | 7/1973 | Stemme | 347/70 |
| 3,946,398 | 3/1976 | Kyser et al. | 347/70 |
| 4,081,577 | 3/1978 | Horner | 396/627 |
| 4,142,107 | 2/1979 | Hatzakis et al. | 430/30 |
| 4,215,927 | 8/1980 | Grant et al. | 396/611 |
| 4,462,860 | 7/1984 | Szmanda | 430/30 |
| 4,501,480 | 2/1985 | Matsui et al. | 396/569 |
| 4,564,280 | 1/1986 | Fukuda | 396/611 |
| 4,594,598 | 6/1986 | Iwagami | 347/37 |
| 4,621,037 | 11/1986 | Kanda et al. | 430/30 |
| 4,636,808 | 1/1987 | Herron | 347/76 |
| 4,736,221 | 4/1988 | Shidara | 396/609 |
| 4,755,844 | 7/1988 | Tsuchiya et al. | 430/30 |
| 4,851,311 | 7/1989 | Millis et al. | 430/30 |
| 4,857,430 | 8/1989 | Millis et al. | 430/30 |
| 5,124,216 | 6/1992 | Giapis et al. | 430/30 |
| 5,155,596 | 10/1992 | Kurtz et al. | 348/97 |
| 5,196,285 | 3/1993 | Thomson | 396/570 |
| 5,292,605 | 3/1994 | Thomson | 430/30 |
| 5,416,550 | 5/1995 | Skye et al. | 396/639 |
| 5,432,579 | 7/1995 | Tokuda | 396/639 |
| 5,440,365 | 8/1995 | Gates et al. | 396/639 |
| 5,465,155 | 11/1995 | Edgar | 358/500 |
| 5,496,669 | 3/1996 | Pfor et al. | 430/22 |
| 5,516,608 | 5/1996 | Hobbs et al. | 430/30 |
| 5,519,510 | 5/1996 | Edgar | 358/471 |
| 5,556,726 | 9/1996 | Yuan | 430/30 |
| 5,678,116 | 10/1997 | Sugimoto et al. | 396/611 |
| 5,698,382 | 12/1997 | Nakahanada et al. | 396/604 |
| 5,870,172 | 2/1999 | Blume | 396/639 |

*Primary Examiner*—D. Rutledge
*Attorney, Agent, or Firm*—Locke Liddell & Sapp LLP

[57] ABSTRACT

An improved developer application method and apparatus for use in electronic film development, wherein the developer is applied to a photographic film using controlled, aerial deposition of one or more stream(s) of droplets of one or more developer agents or developer components such that the droplets adhere to a targeted region of the film, rather than run off, and chemically react to allow scanning of a latent image in the film as it moves through an electronic film development scan mechanism.

46 Claims, 4 Drawing Sheets

METHOD AND APPARATUS FOR ELECTRONIC FILM DEVELOPMENT

RELATED APPLICATION

This application claims the benefit of U.S. Provisional Application No. 60/029,781, filed Oct. 26, 1996.

FIELD OF THE INVENTION

This invention relates to the development of film and more particularly to an improved method and apparatus for electronic film development.

BACKGROUND OF THE INVENTION

In electronic film development, the developing negative is scanned at a certain time interval using infrared light so as not to fog the developing film and to see through antihalation layers. Color is derived from a silver image during development by taking advantage of the milkish opacity of unfixed silver halide to optically separate the three layers sensitive to blue, green, and red. Viewed from the top during development, the top layer is seen clearly, while the lower layers are substantially occluded by the milkish opacity of the top layer. Viewed from the rear during development, the back layer is seen, while the other layers are mostly occluded. Finally, viewed under transmitted light, the fraction of light that does penetrate all three layers is modulated by all, and so contains a view of all three. If the exposures of "front", "back", and "through" views were mapped directly to yellow, cyan and magenta dyes, a pastelized color image would result. However in digital development these three scans, "front", "back" and "through", are processed digitally using color space conversion to recover full color. Electronic film development is described in greater detail in U.S. Pat. No. 5,519,510, issued May 21, 1996 to Edgar.

Conversion of analog images into digital data, or scanning, has become widespread for a variety of uses, including storing, manipulating, transmitting and displaying or printing copies of the image. In order to convert a photographic image into a digital image, the film image frame is transported through a film scanning station, and illuminated in each scan line with a linear light beam of uniform, diffuse illumination, typically produced by a light integrating cavity or integrator. The light transmitted through the illuminated scan line of the image frame is focused by a lens system on a CCD-array image detector which typically produces three primary color light intensity signals for each image pixel that are digitized and stored. Film scanners take a variety of forms and the various common aspects of film image frame digitizing, particularly line illumination and linear CCD array-based digitizers, are described in greater detail in U.S. Pat. No. 5,155,596.

In electronic film development, developer can be applied to the film substrate using a developer pod applied as a viscous fluid under a clear cover film with rollers as more fully described in the aforementioned Edgar et al. patent. Methods of application of developer to film are common knowledge in film development generally, and include sprays, washes, direct dunking, reel dunking, and tank immersion. In one example, developer is delivered through spray pipes which maintain a curtain of developer which cascades over the film. The run-off of excess developer may then be recirculated through the spray pipes for use in the development of other parts of the film. This process utilizes the traditional "wash" method which is followed by a rinse.

In another method of developer application, a film unit passes between two rollers and the force from the rollers ruptures a pod containing a processing fluid. The rollers then proceed to spread the processing fluid along the length of the film which results in the development of the film.

Despite the substantial advantages of electronic film development over conventional film development, which include reduced cost, smaller system size, and minimization of chemical handling, electronic film development is not in common use. One reason is that developer application as disclosed in U.S. Pat. No. 5,519,510 was unreliable and inconsistent in large scale use. Thus, methods and an apparatus for electronic film development which permit controlled application of developer or other chemical solutions without producing run-off are desirable.

SUMMARY OF THE INVENTION

Electronic film development, also known as digital development, is a method of digitizing color film during development. It has potential use in a variety of fields including publishing and commercial photography, and has the potential to be an invaluable tool in the process of image development. Methods which will enable electronic film development to be better practiced are a necessity. The present invention provides advantages throughout the photographic industry by allowing anyone to develop film using electronic film development without expensive equipment, large areas of work space or extensive amounts and numbers of chemicals.

The present invention in one embodiment improves electronic film development through the application of developer using single drop application technology which advantageously results in uniform application of the developer while not applying so much developer that run-off is produced. Other embodiments separate the developing agent and the activator to reduce oxidation thereby increasing shelf-life, and to apply an accelerator to reduce time between scans.

In another embodiment, the invention provides for aerial deposition of a developer to a substrate, where the developer adheres to the substrate without producing run-off, followed by the sensing of an image after the developer has been applied.

In another embodiment of the present invention, developer is aerially deposited on a substrate at a first station, and a modifying solution is aerially deposited at a second station.

Further objects and advantages of the invention will become apparent from a consideration of the drawings and ensuing description.

DETAILED DESCRIPTION OF THE PREFERRED EMBODIMENT

With digital development, the application of the developer should be very controlled to avoid having areas developing due to overspray along a line advancing with time. With a spray or wash, excess amounts of developer is imposed on the film, some if not most of which flows along the surface of the substrate. In a spray type application, the droplets from the developer impinge upon many areas of the film which has the additional problems of nonuniformly overlapping spray patterns. Areas developing prematurely due to overspray from an advancing edge tend to create a grain effect in the scanned image. Washes are also impractical with digital development because with a wash, the developer is continuously moving over the film creating a surface turbulence through which it is difficult to scan and producing an uneven advancing line of developer. Again, a wash does not provide the accuracy of development or clarity of surface viewing needed during digital development. In tank immersion, the entire length of the film is placed in a developer tank. In the tank immersion method, as with a wash, both accuracy of initiation and surface clarity are problems.

Through the use of single drop technology, the application of developer may be better controlled. This controlled application of the developer allows for the precisely calculated time intervals which are required in electronic film development. Additionally, the developer actually applied to the substrate using controlled application is adherent, meaning that it does not flow. Instead, the developer as applied to the substrate generally remains in the area of the substrate where applied, its rate of application being balanced in relation to such factors as the absorbability of the developer into the substrate and the viscosity of the developer with respect to the substrate. Other application factors to be determined are the pressure, temperature, velocity, and volume of the fluid upon application. Once these factors are properly balanced, the single drop technology evenly applies an advancing line of developer, the applied developer forms a developer film on the substrate of generally uniform thickness, and there are no random drops impinging upon areas of the film not intended for development.

Figure 1:
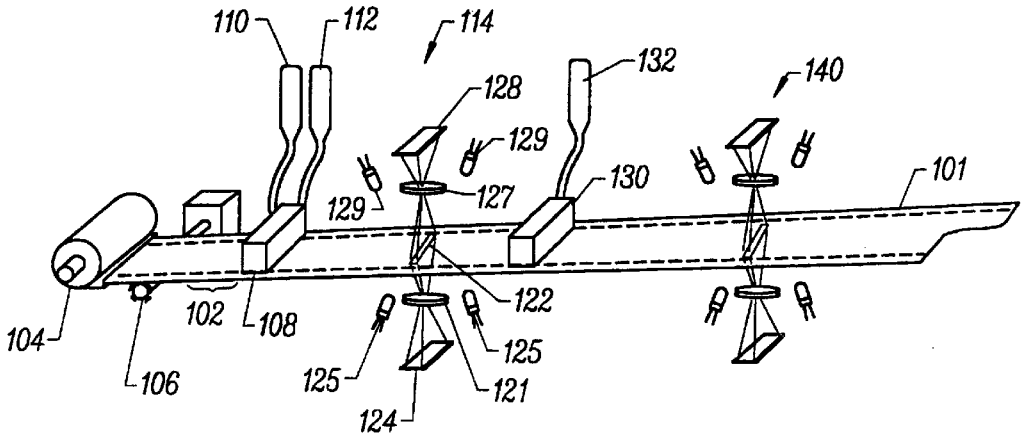
FIG. 1 is a perspective view of a system for the application of developer using "ink jet like" technology, including various scanning stations.

Referring now to FIG. 1, there is depicted a system for the application of a developer to a substrate with a latent image during the scanning process. The substrate most commonly used during this process is referred to as film, which is available from numerous manufacturers, including the Eastman Kodak Company of Rochester, N.Y. The term "film" is not meant to refer to any specific type of film or a specific manufacturer. Developer is a film processing solution defined as anything which acts alone or in concert with other chemicals to resolve that latent image or make the image detectable either visually or by electronic scanning. Processing or developing film are terms commonly used to refer to the overall process of making a latent image detectable, either visually or by electronic scanning. Use of the terms processing fluid, solution or developer are intended to have this common meaning and refer to chemicals which are used in this process. Staple types of developers include HC-110 manufactured by Eastman Kodak of Rochester, N.Y., diluted to a 1:7 dilution.

The system of FIG. 1 includes a film dispensing station (not shown) to hold the substrate film 101 and a sprocketed film advance mechanism 106 which dispenses the film 101. Transport mechanisms for developing film are contained in products manufactured by, for example, Noritsu Koki Co. of Wakayama, Japan and are commonly known in the art. The film 101 is moved along a path to station 108 where a developer is aerially deposited on the film 101 using single drop technology. Aerial deposition refers to movement of the droplets of developer through space from a nozzle to the film, and does not necessarily require any mechanical contact between the nozzle and the film. The film 101 advances continuously to station 114 where it undergoes a preliminary scan displaced in time relative to the application of developer at station 108. After this preliminary scan, the film 101 continues to advance to station 130, where an accelerator is applied, and continues to advance to station 140, where it is scanned a second time at an interval displaced flirther in time. If desired, a third scan follows at another station (not shown) following a third spaced time delay interval. Details of the use of a plurality of spaced time intervals of scanning during the digital development of film can be found in U.S. Pat. No. 5,519,510. Three intervals are chosen for illustration as a typical number.

Referring now to FIG. 1 for more details of a specific digital developer apparatus using aerial deposition technology, the film substrate 101 is fed from a film cartridge 104 as driven by a sprocketed drive mechanism 106. The film substrate 101 is held in a line by supports (not shown). As a film segment 102 is fed along the line, an aerial deposition station 108 applies a coating of a developer as fed from reservoirs 110 and 112. The developer contains a developing agent and activator, as described later in more detail. The developer acts on the latent image in the film segment 102 as it advances to electronic film developer scanning station 114, comprising lens 121 focusing the image from a line 122 on the film segment 102 onto a linear sensor 124. Infrared lights 125 illuminate the film segment 102. A matched lens 127, sensor 128, and infrared lights 129 view the opposite side of the film segment 102. The lights 125 and 129 from each side can be alternately illuminated to provide the front, back, and through images described in more detail later. After scanning, the film segment 102 advances to a second aerial deposition station 130 fed from a reservoir 132 containing an accelerator. Composition and use of this accelerator is described later in more detail. Finally after further development time, the film segment 102 passes through a second electronic film scanning station 140, similar in composition to station 114, to obtain a later view of the developing image. There may be more or fewer electronic imaging stations and more or fewer aerial deposition stations, depending on the features being implemented in a particular apparatus.

Figure 2:
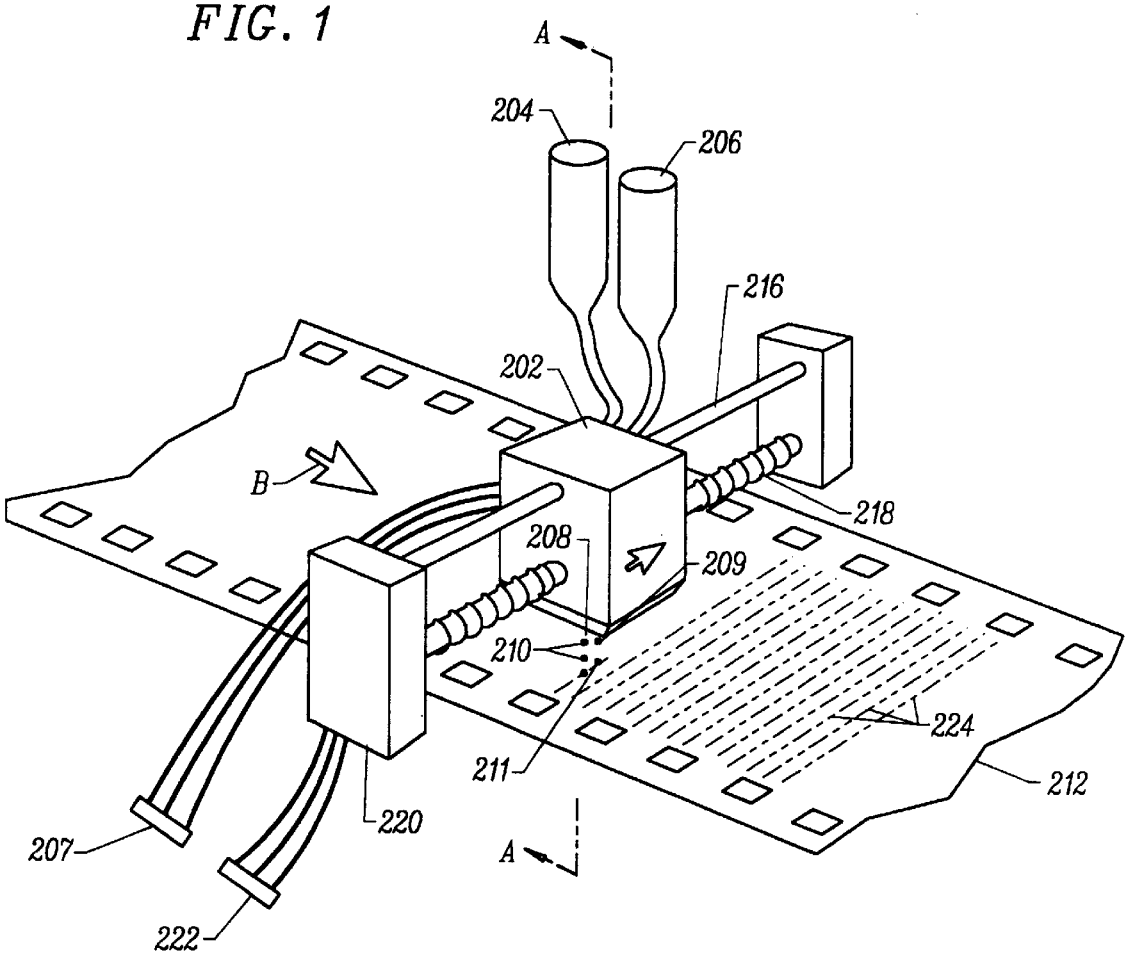
FIG. 2 is a perspective view of the aerial deposition station shown in FIG. 1.

FIG. 2 depicts station 108 shown in FIG. 1 as well as the mechanism for the application of the developer to the substrate. As previously described, when the film enters station 108, developer is applied using single drop technology. A suitable single drop system employs technology similar to an ink jet system printer which includes a printer head mounted on a carriage. As the film advances through the first station, developer is applied as the carriage is moved in a lateral direction across the film. Referring now to FIG. 2, an aerial deposition head 202 is fed fluid from reservoirs 204 and 206. In response to control signals sent to the deposition head 202 (shown here through wires 207), as fed from driving electronics and computer control, the deposition head 202 expels the fluids from reservoirs 204 and 206 through respective nozzles 208 and 209 as aerial droplet streams 210 and 211, respectively, onto a film substrate 212 moving in the direction indicated by arrow B. The aerial deposition head 202 rides along guide 216 propelled by lead screw 218 driven by motor 220 actuated by signals transmitted from driving electronics and computer control (not shown). In one preferred embodiment, such control signals are transmitted through wires 222. The deposition head 202 is driven across the substrate 212 in a scanning motion such that the streams of droplets 210 and 211 are deposited in scan lines 224 across the moving substrate 212. In the illustrated embodiment, aerial deposition is interrupted during retrace so the scan lines 224 are parallel to each other. However, other embodiments are possible; for example the fluids from reservoirs 204 and 206 can combine in the head 202 and emerge from a single nozzle mixed as a single stream of droplets. More or fewer fluids can be combined, and the deposition head 202 can contain more or fewer nozzles for expelling streams of droplets. The droplets can be any of a number of solutions for example developer or constituents of the developer. Examples of suitable deposition head designs are referred to in U.S. Pat. No. 4,636,808 issued to Herron, U.S. Pat. No. 3,946,398 issued to Kyser, and U.S. Pat. No. 3,747,120 issued to Stemme.

The deposition head 202 may have a multi-orifice nozzle, illustratively orifices 208 and 209, where each orifice expels a component of the developer. Details regarding one multi-orifice nozzle system are disclosed in U.S. Pat. No. 4,594,598 issued to Iwagami. In a preferred embodiment of the present invention, nozzle 208 dispenses component solution from reservoir 204, which component solution is a developing agent which reduces silver halide crystals containing latent image centers. Suitable developing agents include, but are not limited to, Elon, phenidone, and hydroquinone dissolved in an aqueous carrier and are commonly manufactured by Eastman Kodak, Agfa, and others. The second nozzle 209 expels an activating agent from reservoir 206, which enables the developing agent to work by elevating the pH of the solution to alkalinity. Types of alkaline activators dissolved in aqueous carriers include, but are not limited to, sodium sulfite and sodium carbonate. The solutions preferably are formulated to material properties similar to ink jet ink. Development takes place only after the developing agent and activating solution become mixed on the substrate 212, which occurs due to mechanical agitation caused by one droplet hitting another and molecular diffusion over the region of a single droplet. Advantageously, deterioration of the developing agent by oxidation is greatly retarded when stored separately from the alkaline activator. Other agents which might be mixed with either the developing agent or alkaline activator, or emitted by additional nozzles and combined on the film include an accelerating agent such as sodium sulfite and sodium carbonate, a hardening agent such as a latex suspension to cause the developer to adhere more securely to the film after drying, a thicksotropic agent such as cornstarch to prevent sagging or running of the developer on the film when wet thereby further improving adherence, and a restrainer such as bromide or benzotriazole. A restrainer added to a developer holds back development of minimally exposed areas, and enhances the highlights by minimizing shadows. Later developer may be used to have the opposite effect to develop shadows preferentially over the highlights. This is done by diluting the restrainer or adding alkalinity. Hardeners and thicksotropic agents are found in latex paint technology and are useful because of the retention of developer on the surface thereby further improving adherence.

Figure 3:
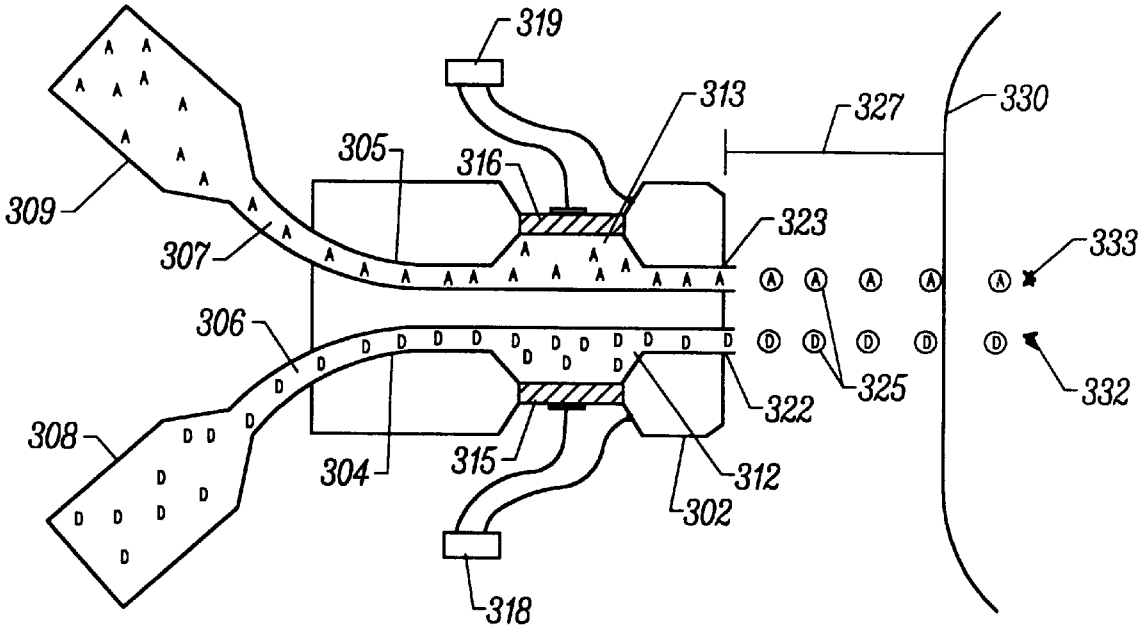
FIG. 3 is a cross-sectional view of a deposition head of the aerial deposition station shown in FIG. 2 taken along line A—A.

As a specific example of a deposition head, FIG. 3 portrays the deposition head 202 of FIG. 2 in a cross-sectional view. Head block 302 has paths 304 and 305 formed through it in order for fluids 306 and 307 from reservoirs 308 and 309 to be expelled. Fluids 306 and 307 may be, illustratively, an agent and an activator respectively. Along each path are cavities 312 and 313 in contact with piezo elements 315 and 316. These piezo elements are excited by electrical impulses along electrical conduits 318 and 319 from driving electronics and computer control. Under piezo constriction, a shock is induced in the cavities 312 and 313 which manifests itself as an acoustic wave that expels the fluids from nozzles 322 and 323 as a series of individual droplets 325. In addition to piezo construction, electromagnetic and thermal forms of droplet expulsion can be used. These expelled droplets 325 traverse the distance 327 to impinge on a substrate 330 as depositions 332 and 333. Because of the motion of the head block 302 and substrate 330 as described previously, the depositions 332 and 333 overlap to mix the fluids on the substrate 330. It may be seen that the fluids could mix inside a single cavity or at a single nozzle and emerge as a single mixed droplet stream; however, to the extent some fluids tend to oxidize once combined, keeping paths 304 and 305 separate reduces the need to clean the heads 302 during extended idle periods. There are many other methods of propelling single droplets from nozzles in a head block 302 as described previously.

Contemporaneously with the application of developer, the film 330 is moved by the rolling mechanism 106 to the next station (station 114 in FIG. 1). Here, the film is scanned using a digital film scanner as described in U.S. Pat. No. 5,519,510 issued to Edgar. Such a scanner includes the ability to illuminate and scan film simultaneously from both sides. More details on the construction of such a scanner can be found in U.S. Pat. No. 5,519,510. The information received during the scan is processed and leads to the generation of an image as described in the referenced patent.

The process used on electronic film development, as described in the aforementioned patent, includes additional scan station 140 and a third scan station (not shown in FIG. 1). In such electronic film development, developer is applied to the film, and then the film is scanned during the development at a number of spaced time intervals. Images are captured during each of the spaced scans and are stored as digital representations of that scan.

In another embodiment (not shown), developer is applied at a first station and, at a second station, a second head applies a development modifier to the film after the first or second scan, to ready the film for subsequent scans. A development modifier, which is anything which affects development of the image on the film, includes but is not limited to an accelerator. One possible effect of a modifier is to increase the sensitivity of the film. It is commonly known in the art that sensitivity of film refers to the "speed" of the film. The application of an accelerator enables one to control the length of the spaced time intervals between the application of the developer and the scans. If three scans are performed, the early scan is of underdeveloped film equivalent to "pull" processing to best see detail in highlight areas. The middle scan is at a "normal" development time, and the late scan is equivalent to "push" processing to best see detail in shadow areas. "Pull" and "push" processing are terms of common use in film development and refer to deviations from normal development times. The interval between the middle and late scans can be as much as ten times the interval between the early and middle scans. By applying an accelerator after the middle scan, this time difference can be compressed. The accelerator can be a more alkaline solution, or can be additional developer to dilute effects of restrainers in the first developer.

Figure 4:
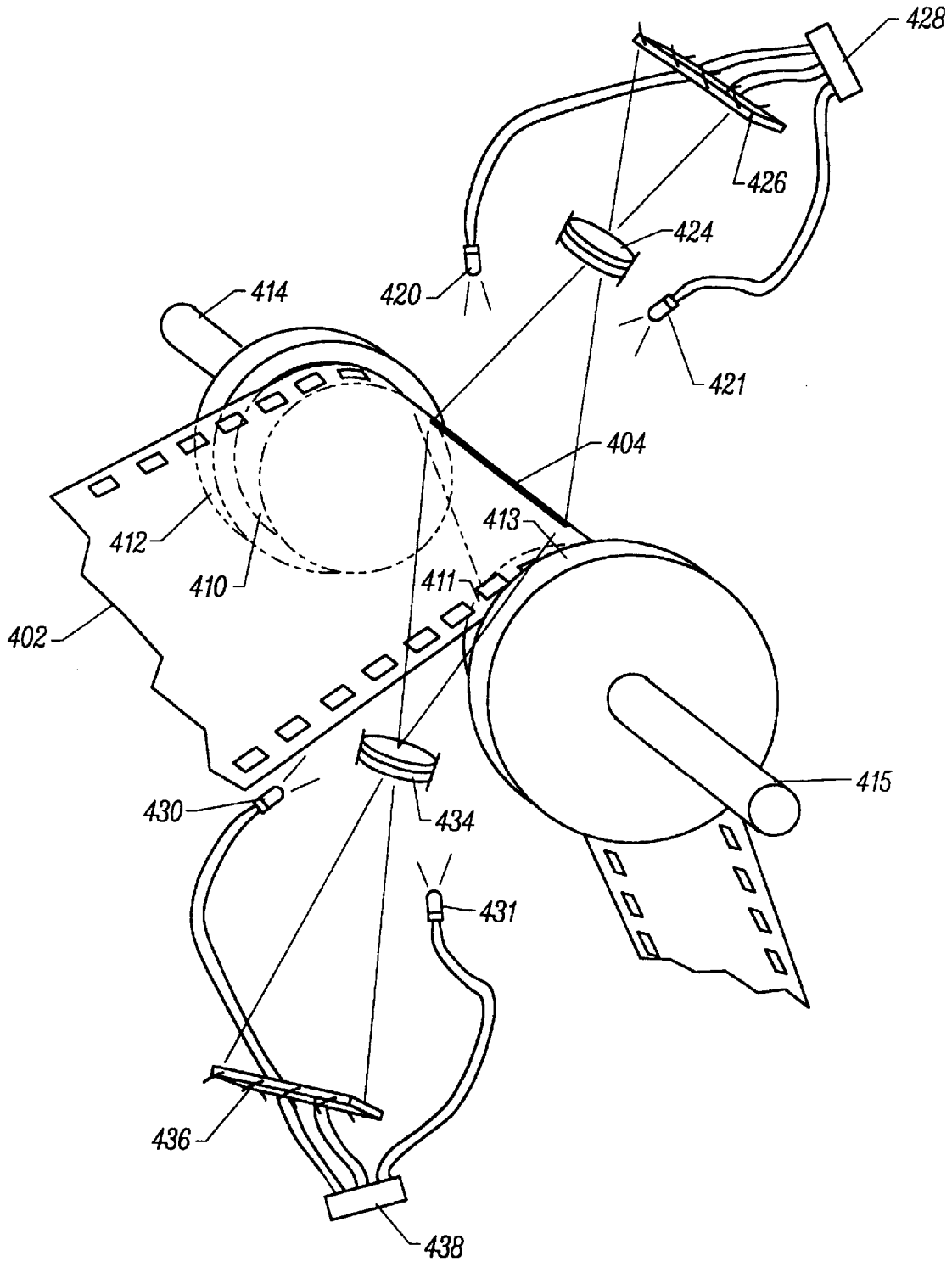
FIG. 4 is a perspective view of a station for two-sided scanning of electronic film development.

Another embodiment of a scanning station where the film is held in an arc perpendicular to the scanning line is shown in FIG. 4. As previously described, the film 402 is handled by a film dispensing station (not shown), a gear rolling system (not shown), and a sprocketeed film advance mechanism (not shown) which dispenses the film 402. The film 402 moves over a first roller (not shown) where the developer application station is located. Here, developer is applied using the deposition head referenced above. After moving across the first roller, the film 402 then advances across a second roller where a scanning station is located. Here, the first scan would take place. Because the film 402 is being scanned from the front and the back, the rollers at the scanning stations preferably have hollow hubs and hollow cores.

FIG. 4 depicts an apparatus and method for performing the two-sided scanning of electronic film development on a film held in an arc. Such an arc is useful for holding wet film 402 effectively flat along a line 404 being scanned from both sides by linear scanners. In this figure, the film 402 is urged by tension to ride against hubs 410 and 411 formed into wheels 412 and 413 on each side of the film 402. The film may be advanced by turning the wheels or by pulling the film under tension over stationary wheels. The supporting shafts 414 and 415 may project axially outward from the center of the wheels 412 and 413 in order to clear an optical path for the film to be illuminated and scanned straight on from both sides. Alternately the wheels 412 and 413 could be supported by a shaft joining the wheels through the center if the optical path of the affected scanner is moved a few degrees off axis to look just over or just under the shaft. Referring again to FIG. 4, infrared lights 420 and 421 illuminate the film 402 along a line 404 to be scanned. This line is imaged through lens 424 onto a linear CCD scanner 426. A scanner 426 is activated by drive electronics (not shown) under computer control along electrical conduits 428 to produce an image of the film 402. Similarly lights 430 and 431, along with lens 434, scanner 436 and electrical conduits 438 act to receive an image of the film 402 from the other side, and the two images combine as described for electronic film development.

The film 402 continues to move across rollers (not shown) where further scans or accelerator applications occur. The benefit of moving the film over a series of rollers as opposed to a straight line mechanism is that the film is kept flat across a line along which developer is applied or a scan is performed with a linear CCD. This addresses the problem found during the flat line processing which is that the film may tend to warp, particularly when wet on one side. During the application of developer, a constant distance is preferably maintained between the film and the head for uniform developer application. The use of the roller obviates this problem as the film will be held in a straight line due to the tension created by the curvature of the rollers. An additional advantage of using curves in the film path is that the apparatus is made more compact. For example, by placing the stations in a circular configuration using rollers, the area needed for the process is reduced. This process is, of course, not limited to a circular or linear configuration. Many other spatial embodiments would reduce warp of the film or reduce the amount of space needed for processing or both. As mentioned in the flat line development shown in FIG. 1, an accelerator application station could be added to a system using rollers.

Figure 5:
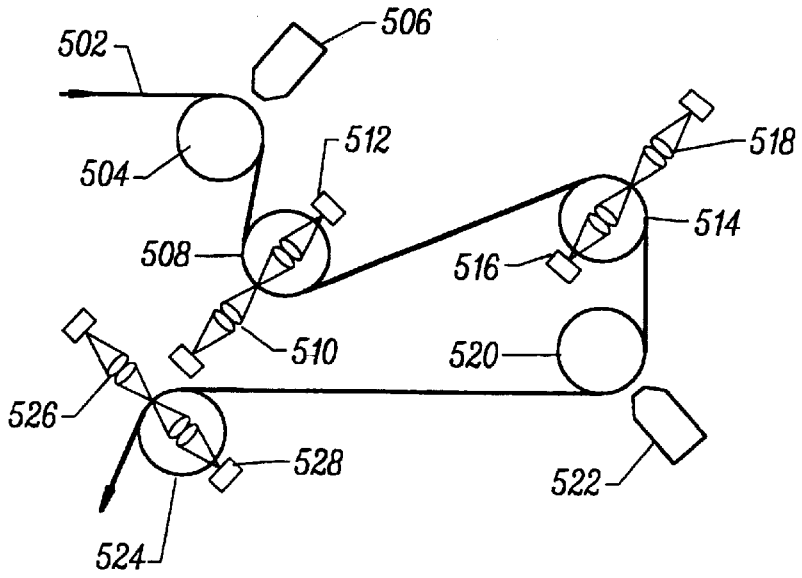
FIG. 5 is a partial plan view of a film path for two-sided scanning of electronic film development.

FIG. 5 provides a more detailed description of a developer application system using a series of rollers using the curved film substrate guides of FIG. 4. The entering film substrate 502 is urged over roller 504 to be held flat along the line of deposition from aerial deposition head 506. The film substrate 502 advances to and over hollow roller 508 and associated electronic film development scanning apparatus 510 and 512. The film substrate 502 further advances over hollow roller 514 and scanning apparatus 516 and 518. From there the film substrate advances over roller 520 and aerial deposition head 522, and finally over hollow roller 524 and scanning apparatus 526 and 528. A folded path is desired to minimize the size of the overall device, although many topologies are possible. Also the use of more or fewer deposition and scanning stations is possible.

Figure 6:
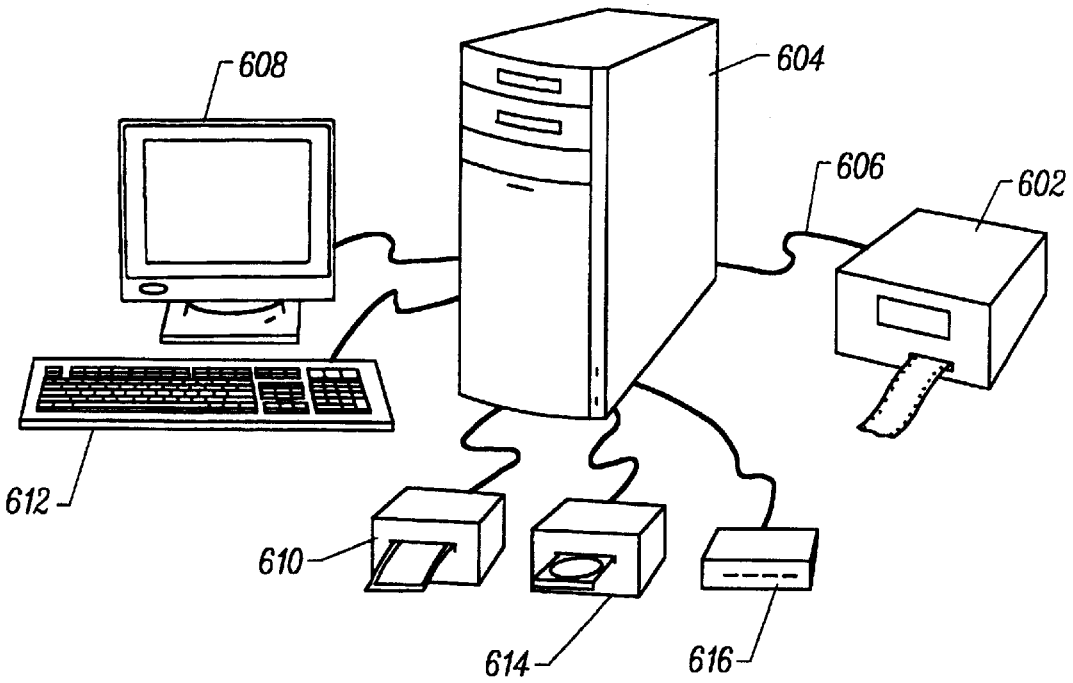
FIG. 6 is a perspective view of a representative system for implementing the invention.

Referring to FIG. 6, the digital developer application apparatus 602 is connected to a computer 604 such as manufactured by Apple Computing Inc. of Cupertino, Calif. The computer 604 controls the application of the developer and the advancement of the film and other functions within application apparatus 602. Once the developer is applied and the film advanced, it is scanned by a digital film scanner contained within apparatus 602 which outputs a digital data file via line 606 connected to the computer 604 for further processing. The computer 604 has attached to it a monitor 608 for display, a printer 610 for printing, a keyboard 612 for data entry and control, an optical disk 614 for data storage, and a modem 616 for communications.

While this invention has been described with an emphasis upon certain preferred embodiments, variations in the preferred composition and method may be used and the embodiments may be practiced otherwise than as specifically described herein. Accordingly, the invention as defined by the following claims includes all modifications encompassed within the spirit and scope thereof.

I claim:

1. A method of obtaining a digital representation of an image, the image corresponding to a previous exposure of a color film containing a silver halide emulsion to light that results in a latent image thereon, comprising the steps of:

aerially depositing a developer onto the color film while the color film is moving past a depositing area so that substantially all of the aerially deposited developer adheres to the emulsion of the color film as a substantially uniform thickness developer film and a monochromatic development process is performed as a result of the adherence to develop the latent image;

irradiating the latent image on the color film with an infrared light while the developer film is applied at the substantially uniform thickness to obtain a light image corresponding to the latent image; and sensing the light image to obtain the digital representation of the image.

2. The method of claim 1 wherein the step of aerially depositing expels droplets from a nozzle.

3. The method of claim 1 wherein the step of aerially depositing expels droplets of the developer that come from a plurality of nozzles.

4. The method of claim 3 wherein at least one of the components contains a developing agent.

5. The method of claim 3 wherein the plurality of nozzles expel several components, and at least one of the components contains an activating agent.

6. The method of claim 3 wherein the plurality of nozzles expel several components, and at least one of the components contains a hardening agent.

7. The method of claim 3 wherein the plurality of nozzles expel several components, and at least one of the components contains a thicksotropic agent.

8. The method of claim 3 wherein the plurality of nozzles expel several components, and at least one of the components contains an accelerating agent.

9. The method of claim 1 further comprising a subsequent aerial deposition of a modifying solution to the emulsion.

10. The method of claim 9 wherein the developer includes a retainer.

11. The method of claim 9 wherein the modifying solution contains a development modifier.

12. The method of claim 11 wherein the development modifier accelerates the development speed.

13. The method claim 13 wherein the developer modifier solution increases the sensitivity of the emulsion to the image.

14. A method of processing a latent image that exists on film comprising selecting a film developing fluid;

forming an aerial droplet stream from the fluid;

applying the aerial droplet stream to the film as the film moves past the aerial droplet stream under application conditions such that the development fluid adheres to the film, thus resulting in a developer film obtained as a result of the fluid substantially remaining in the area of the film to which it was applied to perform a monochromatic development of the film;

irradiating the film with an infrared light while the developer film is applied to obtain a light image corresponding to the latent image that exists on the film; and sensing the light image to obtain a digital representation of the latent image.

15. The method of claim 14 wherein the application conditions of the aerial droplet stream include velocity and volume selected to be compatible with the adherence of the fluid with the film.

16. The method of claim 14 wherein the adherence characteristics of the fluid include viscosity and absorbability into the film selected to be compatible with the adherence of the fluid to the film.

17. The method of claim 14 wherein the aerial droplet stream forming step comprises forming a series of droplets that are substantially uniformly spaced and uniformly sized.

18. The method of claim 14 wherein the movement relative to the film is along a line.

19. The method of claim 14 further comprising the following steps performed before the aerial droplet stream forming step:

storing a first component of the processing fluid in a first reservoir, and storing a second component of the processing fluid in a second reservoir.

20. The method of claim 19 wherein the second component includes a developer enabling agent.

21. The method of claim 19 wherein the second component includes a developer modifying agent.

22. The method of claim 19 further comprising enabling a confluence of the first and second components prior to forming the aerial droplet stream.

23. The method of claim 19 further comprising forming a first aerial droplet stream from the first component and a second aerial droplet stream from the second component, and wherein the first and second aerial droplet streams mix on the film.

24. The method of claim 23 wherein the second droplet stream is applied to a point of film delayed in time relative to a time the first droplet stream is applied to the point of film.

25. The method of claim 24 wherein the first and second droplet streams impinge on the film with functional simultaneity.

26. The method of claim 24 wherein the first and second droplet streams are delayed in time sufficient to permit predetermined interstitial chemical reactions with the film.

27. The method of claim 26 wherein the interstitial chemical reactions include an expansion of an emulsion on the film.

28. The method of claim 26 wherein the interstitial chemical reactions include initiation of development of a latent image on the film through the deposition of a developer agent first droplet stream, and wherein the deposition of the second droplet stream accelerates development of the latent image.

29. A digital film processing apparatus for digitally processing a latent image that exists on a color film comprising:

means for forming an aerial stream of film developer fluid having predetermined adherence characteristics with respect to the color film;

means for applying the aerial stream to the color film as the color film moves past the aerial droplet stream under application conditions compatible with the adherence characteristics of the fluid so that there is obtained a developer film of substantially uniform thickness;

means for irradiating the color film with an infrared light while the developer film is applied to obtain a light image corresponding to the latent image that exists on the film; and means for sensing the light image to obtain a digital representation of the latent image.

30. The apparatus of claim 29 wherein:

the application conditions of the aerial stream include rate and force; and the predetermined adherence characteristics of the fluid include absorbability of the fluid into the film and viscosity of the fluid with respect to the film.

31. The apparatus of claim 29 further comprising means for laterally displacing the aerial stream relative to the film.

32. The apparatus of claim 30 further comprising means for maintaining the aerial stream flow rate constant relative to the rate of film advancement.

33. The apparatus of claim 29 further comprising:

means for forming at least one additional aerial stream from at least one additional film processing fluid having predetermined adherence characteristics with respect to the film; and means for applying an additional aerial stream to the film under application conditions compatible with the adherence characteristics of the fluid.

34. The apparatus of claim 33 further comprising:

means for coordinating the aerial stream applying means and the additional aerial stream applying means so that the aerial stream and the additional aerial stream trajectories are delivered to a mixing point; and means for maintaining the film substantially at the mixing point.

35. A digital film processing apparatus for processing a latent image that exists on a silver halide color photographic film comprising:

a source of photographic film developing fluid;

a chamber coupled to the fluid source;

a pressure pulse generator coupled to the chamber;

a nozzle coupled to the chamber, capable of producing a stream of droplets for controlled aerial deposition of the developer fluid on a surface of the silver halide color photographic film as the color film moves past the nozzle so that the deposited developer fluid substantially remains in the area of the color film to which it was applied and thereby performs a monochromatic development of the color film;

an infrared light source that irradiates the color film with an infrared light while the developer fluid is applied to obtain a light image corresponding to the latent image that exists on the color film; and a sensor that senses the light image to obtain a digital representation of the latent image.

36. The apparatus of claim 35 further comprising a means for positioning the photographic film a predetermined distance from the nozzle, wherein:

the film developer fluid has predetermined adherence characteristics with respect to the photographic film; and the pressure generator and nozzle are configured for maintaining an aerial droplet stream over the predetermined distance under application conditions such that the fluid applied to the photographic film results in the developer film of substantially uniform thickness.

37. The apparatus of claim 36 wherein:

the application conditions of the aerial droplet stream include rate and force; and the predetermined adherence characteristics of the fluid include absorbability of the fluid into the film and viscosity of the fluid with respect to the film.

38. The apparatus of claim 35 further comprising a film handling mechanism having a fluid application station, the nozzle having a predetermined relationship relative to the fluid application station.

39. The apparatus of claim 38 wherein the film handling mechanism further comprises:

a film dispensing station; and a film advance mechanism for advancing the film from the film dispensing station through the fluid application station.

40. The apparatus of claim 39 wherein the fluid application station comprises a planar surface region in space, the film advance mechanism being disposed for advancing film from the film dispensing station through the planar surface region.

41. The apparatus of claim 40 further comprising a linear drive coupled to the nozzle, the linear drive being parallel to the planar surface region.

42. The apparatus of claim 39 wherein the fluid application station comprises an arced surface in space, the film advance mechanism being disposed for advancing film from the film dispensing station through the arced surface region.

43. The apparatus of claim 42 further comprising a linear drive coupled to the nozzle, the linear drive capable of moving the nozzle in a line parallel to the arced surface region.

44. The apparatus of claim 35 wherein the source of photographic film developing fluid comprises a reservoir for storing the fluid.

45. The apparatus of claim 35 wherein the source of photographic film developing fluid comprises:

a first reservoir storing a first constituent of the fluid; and a second reservoir storing a second constituent of the fluid.

46. The apparatus of claim 35 further comprising:

at least one additional source of an additional photographic film processing fluid;

an additional chamber coupled to the additional fluid source;

an additional pressure pulse generator coupled to the additional chamber; and an additional nozzle coupled to the chamber;

wherein the nozzle and the additional nozzle are capable of producing a stream of droplets directed to a mixing point.

* * * * *

UNITED STATES PATENT AND TRADEMARK OFFICE

CERTIFICATE OF CORRECTION

PATENT NO : 5,988,896

DATED : November 23, 1999

INVENTOR(S): Albert D. Edgar

It is certified that error appears in the above-identified patent and that said Letters Patent are hereby corrected as shown below:

Column 9, Claim 13 should read --The method of claim 11 wherein the developer modifier solution increases the sensitivity of the emulsion to the image--.

Signed and Sealed this

Twenty-seventh Day of June, 2000

*Attest:*

Q. TODD DICKINSON

*Attesting Officer*

*Director of Patents and Trademarks*